US006966368B2

(12) United States Patent
Farquhar

(10) Patent No.: US 6,966,368 B2
(45) Date of Patent: Nov. 22, 2005

(54) PLUG AND EXPEL FLOW CONTROL DEVICE

(75) Inventor: Graham E. Farquhar, New Deer Turriff (GB)

(73) Assignee: Baker Hughes Incorporated, Houston, TX (US)

( * ) Notice: Subject to any disclaimer, the term of this patent is extended or adjusted under 35 U.S.C. 154(b) by 126 days.

(21) Appl. No.: 10/602,578

(22) Filed: Jun. 24, 2003

(65) Prior Publication Data

US 2004/0262016 A1 Dec. 30, 2004

(51) Int. Cl.[7] ..... E21B 43/00; E21B 23/00
(52) U.S. Cl. ..... 166/128; 166/316
(58) Field of Search ..... 166/179, 126, 166/128, 135, 142, 151, 187, 192, 195, 196, 166/316, 318, 319, 325, 326, 327

(56) References Cited

U.S. PATENT DOCUMENTS

| | | | | |
|---|---|---|---|---|
| 2,829,719 A | | 4/1958 | Clark, Jr. | |
| 3,054,415 A | | 9/1962 | Baker et al. | |
| 4,474,241 A | * | 10/1984 | Freeman | 166/317 |
| 4,566,541 A | | 1/1986 | Moussy et al. | 166/318 |
| 4,606,408 A | | 8/1986 | Zunkel et al. | 166/278 |
| 4,823,882 A | | 4/1989 | Stokley | 166/387 |
| 4,828,037 A | | 5/1989 | Lindsey et al. | 166/382 |
| 4,893,678 A | | 1/1990 | Stokley et al. | 166/374 |
| 5,146,992 A | * | 9/1992 | Baugh | 166/383 |
| 5,244,044 A | | 9/1993 | Henderson | 166/332 |
| 5,413,172 A | * | 5/1995 | Laurel | 166/153 |
| 5,762,142 A | * | 6/1998 | Connell et al. | 166/325 |
| 5,797,454 A | * | 8/1998 | Hipp | 166/196 |
| 5,890,538 A | | 4/1999 | Beirute et al. | 166/285 |
| 5,996,696 A | | 12/1999 | Jefree et al. | 166/386 |
| 6,102,060 A | * | 8/2000 | Howlett et al. | 137/1 |
| 2001/0045288 A1 | | 11/2001 | Allamon et al. | 166/373 |
| 2002/0162261 A1 | | 11/2002 | Krauss et al. | |

* cited by examiner

*Primary Examiner*—Frank S. Tsay
(74) *Attorney, Agent, or Firm*—Madan, Mossman & Sriram, P.C.

(57) ABSTRACT

Devices and methods for fluid flow control within a production tubing string wherein a temporary flow blockage is established and selectively removed from the tubing string so that pressure testing or operation of a hydraulic tool within the string may be performed. A flow control device includes a housing that defines a flowbore therethrough with a restricted diameter portion. The restricted diameter portion presents a seating surface for a plug member and is provided by an annular shell that is shaped to project convexly inwardly. The shell may be fashioned of metal, elastomer or another suitable material, and it is capable of yielding to permit passage of a plug member upon application of a suitably great amount of fluid pressure. In operation, a plugging member is dropped in to the tubing string from the surface of the well and seats upon the seating surface. The tubing string is then pressured up to a first fluid pressure level for testing, tool operation, or the like, and the pressuring up will urge the plugging member against the plug seat in order to effect a fluid seal. When it is desired to remove the plugging member from the tubing string, and reestablish fluid flow through the tubing string, fluid pressure above the plugging member is raised to a second, overpressure level. The plug is then urged through the restricted diameter portion and expelled from the device to the wellbore sump below.

26 Claims, 3 Drawing Sheets

PLUG AND EXPEL FLOW CONTROL DEVICE

BACKGROUND OF THE INVENTION

1. Field of the Invention

The invention relates generally to flow control devices for establishing temporary obstructions within a tubing string. In certain aspects, the invention also relates to devices and methods for pressure testing of production tubing within a hydrocarbon production well or for operating hydraulic tools within a tubing string.

2. Description of the Related Art

After a production well is drilled, cased, and, if required perforated, a string of production tubing is run into the cased wellbore. Hydrocarbons from a downhole formation are then drawn into the production tubing, under impetus of a surface-based pump, and brought to the surface of the well. After the production tubing is run into the wellbore, it is desirable to test the pressure integrity of the tubing before drawing production fluid from the formation. Leaks in the production tubing string result in inefficient production and can be costly to repair after production has begun.

In order to pressure test the production tubing, it is necessary to create a temporary plug or obstruction within the tubing string. Fluid is then introduced above the obstruction and pressurized so that any leakage can be detected. After testing, the obstruction must be removed from the tubing string. In other instances, it may be desirable to establish a temporary obstruction within the tubing string in order to actuate a hydraulic tool within the tubing string above the obstruction.

Unfortunately, current temporary plug flow control devices are problematic or less than reliable in practice. U.S. Pat. No. 5,996,696 issued to Jeffree et al. describes a rupture disk arrangement wherein a rupture disk, typically formed of nickel, is incorporated into the tubing string prior to running the tubing string into the wellbore. This type of device is also known commercially as a "well test membrane." This arrangement is unsatisfactory for some purposes since it does not allow passage of fluid or tools through the tubing string while the tubing string is being tripped into the wellbore. The intact rupture disk prevents such passage.

The Model E Hydro Trip pressure sub, by Baker Oil Tools, is another flow control device that is used to establish a temporary blockage within a tubing string. This device uses collet fingers to provide a restricted-diameter ball seat upon which a plugging ball is seated to establish a fluid blockage. Upon the application of a predetermined amount of pressure within the tubing string above the plugging ball, several shear screws are sheared, permitting a sleeve within the tubing string to slide downwardly within the flowbore so that the collet fingers can retract back into a matching recess in the flowbore wall, thereby allowing the plugging ball to fall into the well sump below and result in an unplugged condition. This device may malfunction if the shear screws do not shear at the intended fluid pressure, or do not all shear at the same time, thereby causing the sliding sleeve to become stuck or to slide prematurely. In addition, this arrangement can only be used a single time. Once the shear screws have been sheared, no other plugging ball will be supported upon the ball seat unless the tubing string is first removed from the wellbore and then reset. This, of course, is costly and time consuming.

Also known is a shear-out ball seat sub that provides a temporary blockage of a portion of the tubing string when a ball-shaped plug is dropped into a tubing string and then seated upon a seating arrangement that is provided by a frangible member. The blockage is later removed by shearing away a frangible member to allow the plug to drop into the well sump. Unfortunately, this type of arrangement can only be located at the lower end of the tubing string and no other points along the tubing string, thereby limiting its usefulness. This arrangement, of course, is also limited to a single use.

The present invention addresses the problems of the prior art.

SUMMARY OF THE INVENTION

The invention provides devices and methods for fluid flow control within a production tubing string wherein a temporary flow blockage is established and selectively removed from the tubing string so that pressure testing or operation of a hydraulic tool within the string may be performed. The flow control device does not require frangible members, such as shear screws to operate and may be reusable. Fluids and tools may be passed through the device as the device is tripped in.

In an exemplary embodiment, the flow control device includes a housing that defines a flowbore therethrough with a restricted diameter portion. The restricted diameter portion presents a seating surface for a plug member and is provided by an annular shell that is shaped to project convexly inwardly. The shell may be fashioned of metal, elastomer or another suitable material, and it is capable of yielding to permit passage of a plug member upon application of a suitably great amount of fluid pressure. In operation, a plugging member is dropped in to the tubing string from the surface of the well and seats upon the seating surface. The tubing string is then pressured up to a first fluid pressure level for testing, tool operation, or the like, and the pressuring up will urge the plugging member against the plug seat in order to effect a fluid seal.

When it is desired to remove the plugging member from the tubing string, and reestablish fluid flow through the tubing string, fluid pressure above the plugging member is raised to a second, overpressure level. The plug is then urged through the restricted diameter portion and expelled from the device to the wellbore sump below.

DETAILED DESCRIPTION OF THE PREFERRED EMBODIMENTS

Figure 1:
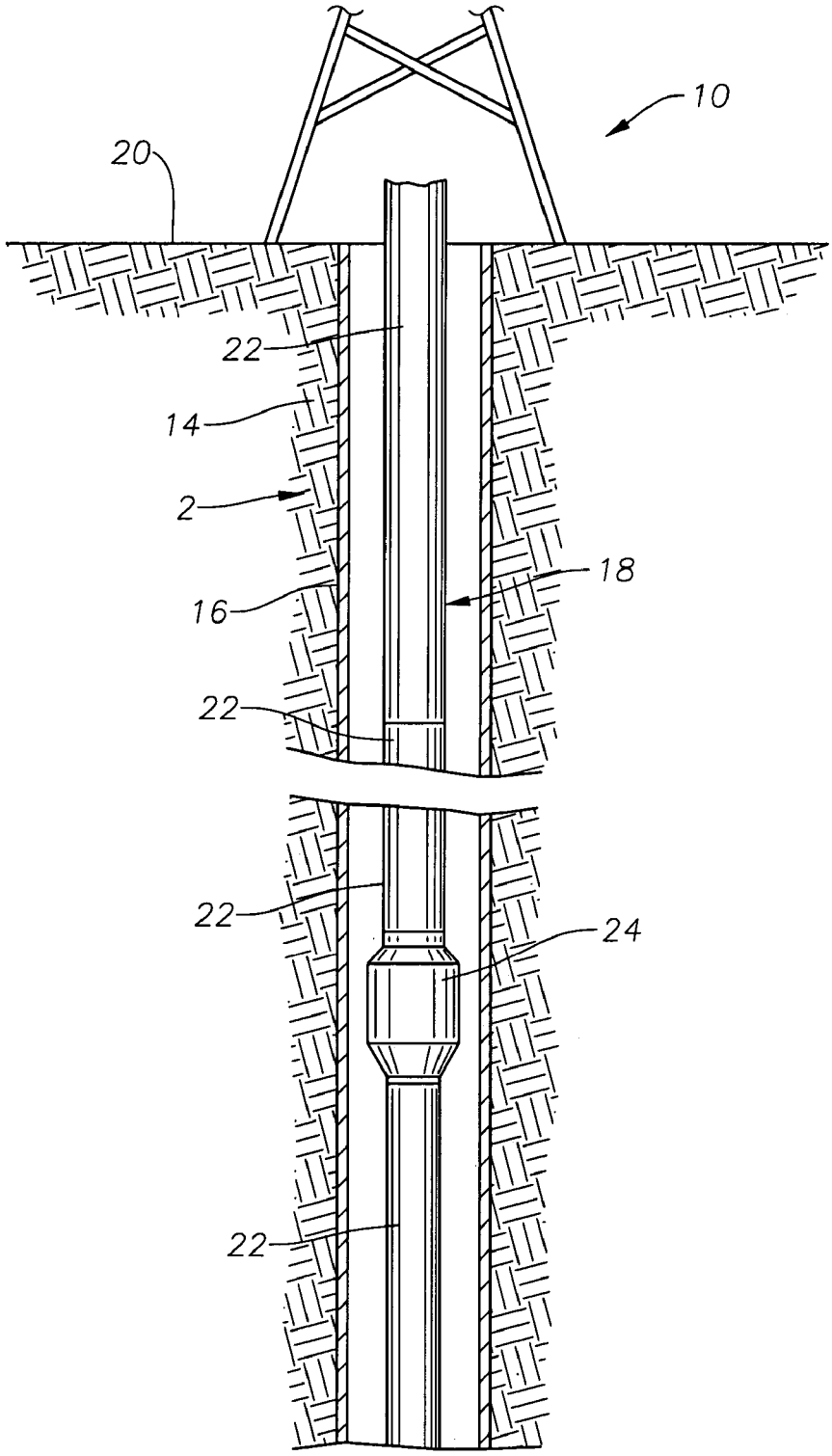
FIG. 1 is a side, cross-sectional view of an exemplary wellbore having a production tubing string disposed therein which incorporates a plug and expel device constructed in accordance with the present invention.

FIG. 1 schematically illustrates an exemplary production well 10 having a wellbore 12 disposed through the earth 14 to a formation (not shown). The wellbore 12 is cased by casing 16. A production tubing string 18 is disposed within the wellbore 12 from the surface 20 of the well 10, in preparation for the production of hydrocarbons from the formation.

The production tubing string 18 is made up of a series of individual tubing sections 22, which are affixed to one another by threading, as is known in the art. The tubing string 18 also includes a plug and expel device 24 that is constructed in accordance with the present invention.

The structure and operation of the plug and expel device 24 is better appreciated with reference to FIGS. 2, 2A, 3 and 3A. As shown there, the plug and expel device 24 includes a tubular outer sub, or housing, 26 having upper and lower axial ends 28, 30. The ends 28, 30 of the sub 26 are threaded to allow the sub 26 to be incorporated into the tubing string 18 by threaded interconnection with neighboring tubing sections 22. The sub 26 defines a fluid flowbore 32 axially therethrough. When the sub 26 is interconnected with neighboring tubing sections 22, the flowbore 32 is aligned with the fluid flowbores defined within those neighboring sections 22, thereby allowing fluids to pass through the production tubing string 18. A restrictive throat, generally shown at 34, is contained within the flowbore 32 and permits a plugging member, such as tripping ball 36, to be selectively seated thereupon to block fluid flow within the tubing string 18. The restrictive throat 34 is formed by an annular convex shell, or membrane, 38 that protrudes inwardly from the walls of the flowbore 32 to provide a reduced diameter restriction within the flowbore 32. In preferred embodiments, the shell 38 is formed of a flexible material. The shell 38 is non-rigid and capable of yielding, in an elastic or plastic manner, upon application of a predetermined force. In currently preferred embodiments, the shell 38 is formed of a metal alloy. Additionally, a plastic or composite compound having suitable resilience properties might be used to construct the shell 38. The shell 38 is radially inwardly convex in shape and preferably encloses an annular fluid chamber 40. In some embodiments, the fluid chamber 40 is preferably filled with a fluid that assists in controlled yielding of the shell 38 and portions thereof. Suitable fluids for this application include nitrogen and water. Additionally, silicon type oil might be used. Fill port 42 is disposed through the housing 26 to permit filling of the fluid chamber 40. Drain plug 44 is disposed within the fill port 42 to close it off when not in use. In another exemplary embodiment, the restrictive throat 34 may be an elastomeric bladder element that is inflated with fluid.

Figure 2A:
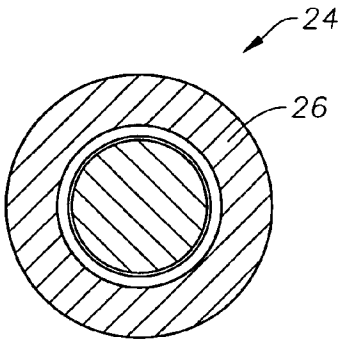
FIG. 2A is an axial cross-section taken along lines A—A in FIG. 2.
Figure 2:
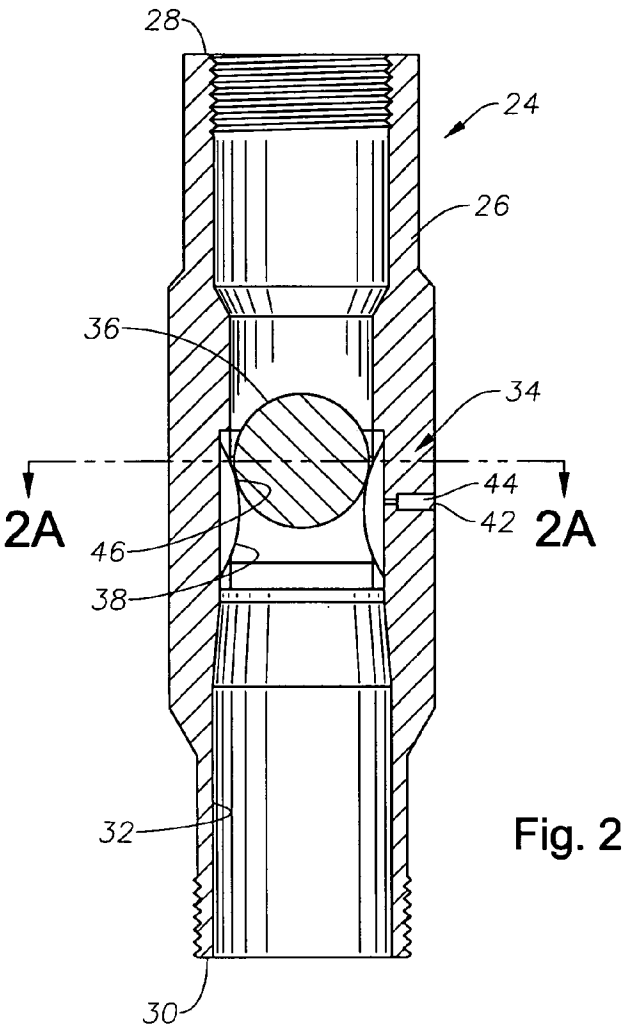
FIG. 2 is a side, cross-sectional view of an exemplary plug and expel device wherein the plugging member is shown seated for temporary obstruction of the tubing string.
Figure 3A:
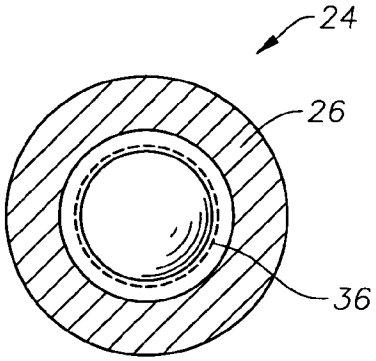
FIG. 3A is an axial cross-section taken along lines A—A in FIG. 3.
Figure 3:
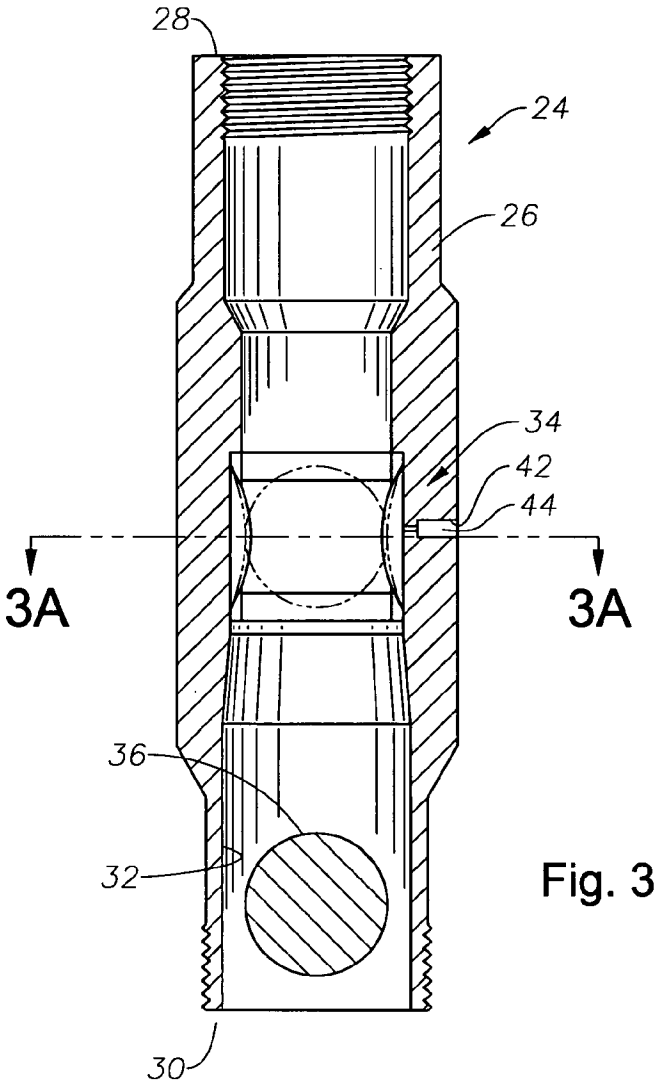
FIG. 3 is a side cross-sectional view of the exemplary plug and expel device shown in FIGS. 2 and 2A, now with the plugging member having been expelled from within.

The shell 38 is secured within the flowbore 32 by press fitting, such as cryogenic fitting, or by other methods known in the art. As is apparent from FIG. 2, the shell 38 provides an annular seating surface 46 for receiving the tripping ball 36. While a spherical tripping ball 36 is shown in FIGS. 2 and 3, it should be understood by those of skill in the art that plugging members of other suitable shapes (such as cylindrical) might be used as well, so long as a suitable fluid seal will be formed with the seating surface 46 when fluid pressure is applied to the ball 36.

In operation, the plug and expel device 24 is integrated into the string of production tubing 18 and then run into the wellbore 12. Fluids and tools are able to pass through the tubing string 18 and the flowbore 32 of the plug and expel device 24, as necessary. Once the production tubing string 18 is run in so that the device 24 is disposed at a desired depth, the tubing string 18 can be prepared for testing by dropping the tripping ball 36, or other suitable plugging member, into the tubing string 18 from the surface 20. The ball 36 will become seated upon the seating surface 46. The tubing string 18 may then be pressure tested by increasing fluid pressure within the tubing string 18 at the surface and, as a result, above the ball 36. The fluid pressure is increased only to a first level, which is suitable for pressure testing the tubing string 18 but not sufficient to dislodge the ball 36 from the restricted throat portion 34 of the flow control device 24. Those of skill in the art will recognize that, in lieu of pressure testing of the tubing string 18, the pressure might also be increased within the tubing string 18 in order to operate a hydraulic tool, inflate a packer, or the like.

Upon application of a predetermined overpressure, the tripping ball 36 will be urged through the restricted throat portion 34 and fall into the sump (not shown) at the bottom of the well 10. The shell 38 is elastically deformed by the tripping ball 36 and portions of the shell 38 will yield by moving radially outwardly to accommodate passage of the ball 36. The ball 36 is thereby expelled from the flow control device 24 and will then drop into the sump (not shown) at the bottom of the wellbore 12.

It is noted that the flow control device 24 may also be reused after the ball 36 has been expelled from the restricted throat 34 since the shell 38 will tend to return to its undeformed shape, thereby again presenting the seating surface 46 for a second tripping ball 36 to be landed thereupon. The second tripping ball 36 may be selectively expelled from the device 24 in the manner described previously. The reuseable nature of the device 24 is highly advantageous since it permits, for example, pressure tests to be performed after some period of production operation.

Those of skill in the art will recognize that numerous modifications and changes may be made to the exemplary designs and embodiments described herein and that the invention is limited only by the claims that follow and any equivalents thereof.

What is claimed is:

1. A flow control device for selectively closing a tubing string to fluid flow therethrough, the device comprising:

a housing defining a flowbore therethrough;

a shell retained within the flowbore to provide a flowbore portion having a restricted diameter, the shell presenting a plug member seat and projecting radially inward to the flowbore;

a plug member shaped and sized to fit within the flowbore and be seated upon the plug member seat; and the shell being deformable to permit the plug member to pass through the restricted diameter upon application of a predetermined amount of force to the plug member.

2. The flow control device of claim 1 wherein the shell is plastically deformable.

3. The flow control device of claim 1 wherein the plug member is spherically shaped.

4. The flow control device of claim 1 wherein the shell is formed of metal.

5. The flow control device of claim 1 wherein the shell is formed of an elastomeric material.

6. The flow control device of claim 1 wherein the shell is formed of a plastic material.

7. The flow control device of claim 1 wherein the shell is formed of a composite material.

8. The flow control device of claim 1 wherein the shell is annular.

9. A flow control device for selectively closing a tubing string to fluid flow therethrough, the device comprising:

a housing defining a flowbore therethrough;

a radially inwardly projecting seal member retained within the flowbore to provide a flowbore portion having a restricted diameter, the seal member presenting a plug member seat;

a plug member adapted to seat upon the plug member seat, the seal member being adapted to permit the plug member to pass through the restricted diameter upon application of a predetermined amount of force to the plug member, wherein the seal member is elastically deformable.

10. A flow control device for selectively closing a tubing string to fluid flow therethrough, the device comprising:

a housing defining a flowbore therethrough;

a seal member retained within the flowbore to provide a flowbore portion having restricted diameter, the seal member presenting a plug member seat;

a plug member adapted to seat upon the plug member seat, the seal member being deformable to permit the plug member to pass through the restricted diameter upon application of a predetermined amount of force to the plug member, wherein the seal member defines an annular fluid chamber.

11. The flow control device of claim 10 wherein the annular fluid chamber is filled with fluid.

12. The flow control device of claim 11 wherein the fluid comprises nitrogen.

13. The flow control device of claim 11 wherein the fluid comprises water.

14. The flow control device of claim 11 wherein the fluid comprises silicon type oil.

15. A flow control device for selectively closing a tubing string to fluid flow therethrough, the device comprising:

a housing defining a flowbore therethrough;

a shell retained within the flowbore to provide a flowbore portion having a restricted diameter, the shell further presenting a plug member seat and projecting radially inward to the flowbore; and the shell being deformable to permit a plug member to pass through the restricted diameter upon application of a predetermined amount of force to the plug member.

16. The flow control device of claim 15 wherein the shell is plastically deformable.

17. The flow control device of claim 15 further comprising a plug member shaped and sized to fit within the flowbore and be seated upon the plug member seat.

18. The flow control device of claim 15 wherein the shell defines an annular fluid chamber that is filled with fluid.

19. The flow control device of claim 15 wherein the shell is substantially formed of a metal alloy.

20. The flow control device at claim 15 wherein the shell is formed of an elastomeric material.

21. The flow control device of claim 15 wherein the shell is formed of a plastic material.

22. The flow control device of claim 15 wherein the shell is formed of a composite material.

23. A flow control device for selectively closing a tubing string to fluid flow therethrough, the device comprising:

a housing defining a flowbore therethrough;

a seal member selectively restricting a diameter of the flowbore to obstruct passage of a plug member through the flowbore, the seal member being deformable to permit the plug member to pass through the restricted diameter upon application of a predetermined amount of force to the plug member, wherein the seal member is elastically deformable.

24. A method of flow control within a production tubing string for temporarily blocking flow through the tubing string, the method comprising the steps of:

incorporating a flow control device within a tubing string, the flow control device having a housing defining a flowbore therein, and a restricted throat portion within the flowbore formed by a shell that presents a plug member seat and projects radially inward to the flowbore;

disposing a plug member within the tubing string to seat the plug member upon the plug member seat;

increasing fluid pressure within the tubing string above the plug member to a first level to create a fluid seal, thereby blocking fluid flow within the tubing string; and increasing fluid pressure within the tubing string above the plug member to a second level to force the plug member through the restricted throat portion and unblock the tubing string to fluid flow therethrough.

25. A method of flow control within a tubing string for temporarily blocking flow through the tubing string, the method comprising:

incorporating a flow control device within a tubing string, the flow control device having a housing defining a flowbore therein and a restricted throat portion within the flowbore formed by a seal member that presents a plug member seat;

disposing a plug member within the tubing string to seat the plug member upon the plug member seat;

increasing fluid pressure within the tubing string above the plug member to a first level to create a fluid seal, thereby blocking fluid flow within the tubing string; and increasing fluid pressure within the tubing string above the plug member to a second level to force the plug member through the restricted throat portion and unblock the tubing string to fluid flow therethrough, and further comprising:

disposing a second plug member within the tubing string to seat upon the plug member seat;

increasing fluid pressure within the tubing string above the second plug member to said first level to create a fluid seal, thereby blocking fluid flow within the tubing string.

26. The method of claim 25 further comprising the step of increasing fluid pressure within the tubing string above the second plug member to a second level to force the second plug member through the restricted throat portion and unblock the tubing string to fluid flow therethrough.

* * * * *